US011717121B2

(12) United States Patent
Delair et al.

(10) Patent No.: US 11,717,121 B2
(45) Date of Patent: Aug. 8, 2023

(54) ROBOTIC VACUUM CLEANER WITH AT LEAST ONE FIXED SIDE CLEANING MEMBER

(71) Applicant: SEB S.A., Ecully (FR)

(72) Inventors: Laurent Delair, Saint-Etienne-du-Rouvray (FR); Mickael Boillet, Martainville-Epreville (FR)

(73) Assignee: SEB S.A.

( * ) Notice: Subject to any disclaimer, the term of this patent is extended or adjusted under 35 U.S.C. 154(b) by 0 days.

(21) Appl. No.: 17/674,154

(22) Filed: Feb. 17, 2022

(65) Prior Publication Data

US 2022/0257073 A1 Aug. 18, 2022

(30) Foreign Application Priority Data

Feb. 18, 2021 (FR) ..... 2101608

(51) Int. Cl.
*A47L 9/06* (2006.01)
*A47L 9/04* (2006.01)

(52) U.S. Cl.
CPC ..... *A47L 9/062* (2013.01); *A47L 9/0477* (2013.01); *A47L 9/0488* (2013.01); *A47L 2201/00* (2013.01)

(58) Field of Classification Search
CPC ..... A47L 9/062; A47L 9/0477; A47L 9/0488; A47L 2201/00; A47L 9/0466; A47L 9/04; A47L 11/24; A47L 5/12; A47L 9/00; A47L 9/0606; A47L 9/10; A47L 11/33; A47L 11/40; A47L 11/4011; A47L 11/4013; A47L 11/4036; A47L 11/4041; A47L 11/4072; A47L 11/4094; A47L 9/068

See application file for complete search history.

(56) References Cited

U.S. PATENT DOCUMENTS 4,219,902 A * 9/1980 DeMaagd ..... A47L 9/062 15/364
10,678,254 B1 6/2020 Jonas et al.
2008/0092324 A1 4/2008 Liao

FOREIGN PATENT DOCUMENTS

GB 2372432 A * 8/2002
KR 20060112947 A 11/2006
WO 2021016024 A1 1/2021

OTHER PUBLICATIONS

Search Report for French Application No. FR 2101608 dated Oct. 20, 2021. 2 pgs.(see p. 1, categorizing the cited references).

* cited by examiner

*Primary Examiner* — David Redding
(74) *Attorney, Agent, or Firm* — Lerner David LLP

(57) ABSTRACT

A robotic vacuum cleaner includes a main body having an underside configured to face a surface to be cleaned, a suction opening that opens into the underside of the main body and extending transversely to a main direction of travel of the robotic vacuum cleaner; and a first side cleaning member attached at a fixed location on a front part of the main body and located adjacent a first side edge of the main body, the first side cleaning member having a first cleaning part which is flexible and is configured to direct waste, which comes into contact with the first cleaning part when the robotic vacuum cleaner moves in the main direction of travel, toward the suction opening.

16 Claims, 6 Drawing Sheets

[Fig. 1]
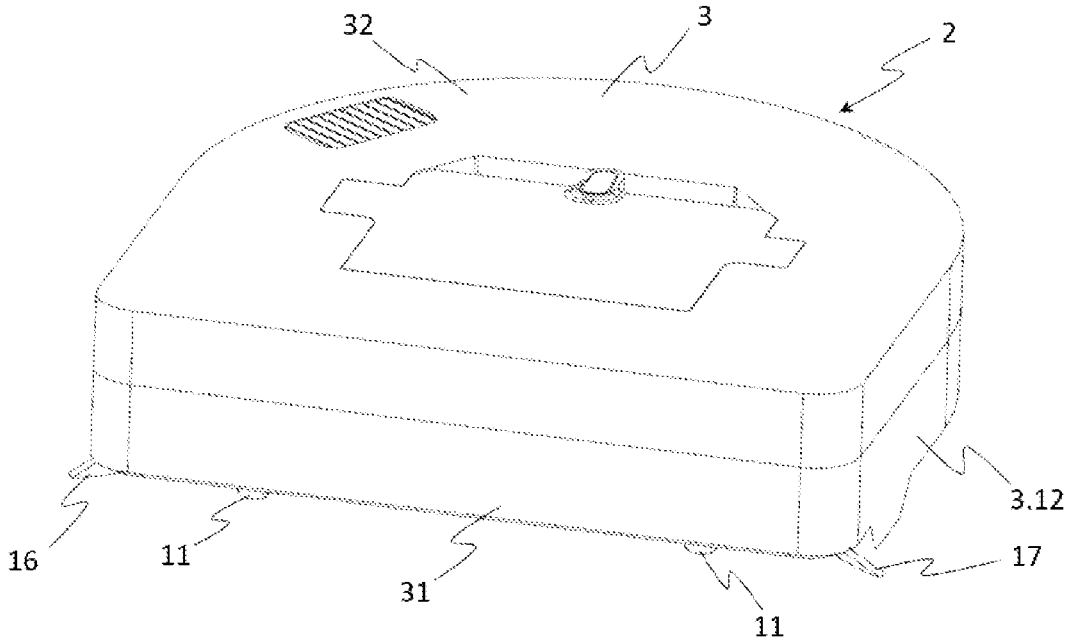
[Fig. 2]
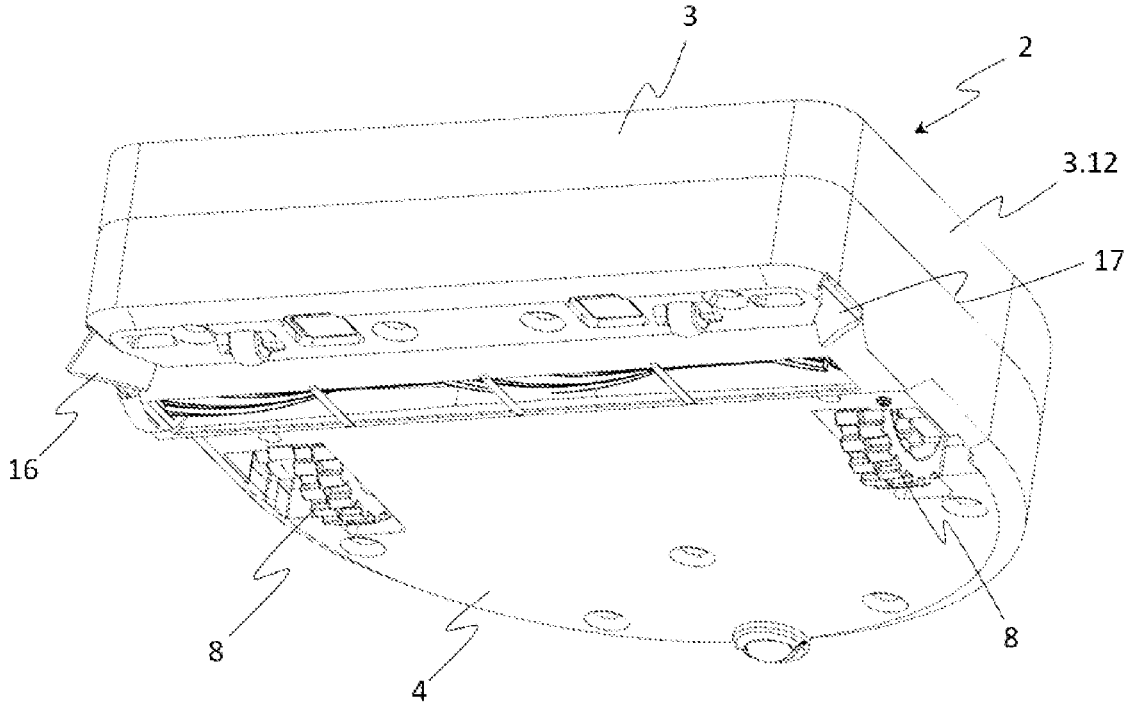

[Fig. 3]
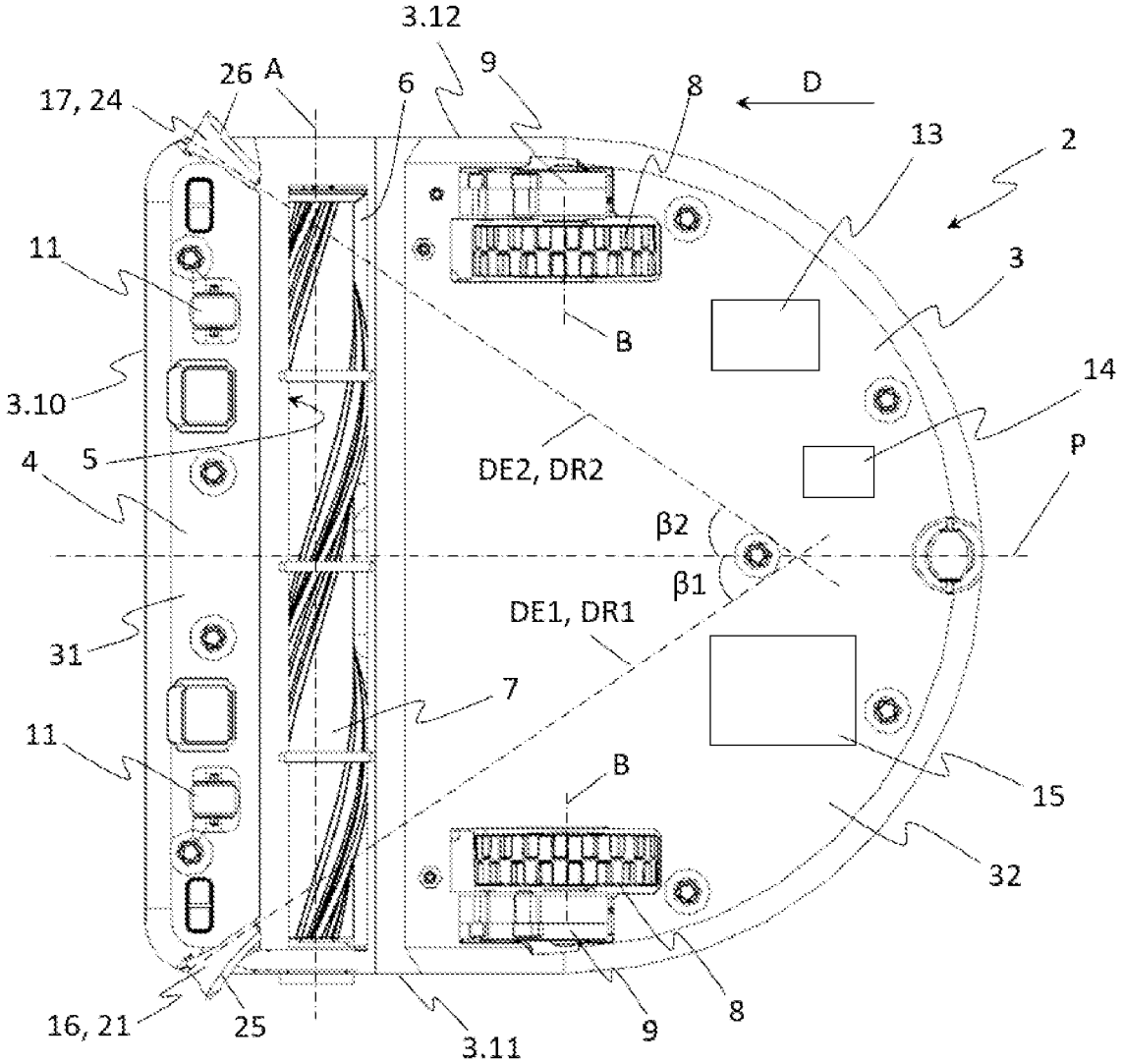
[Fig. 4]
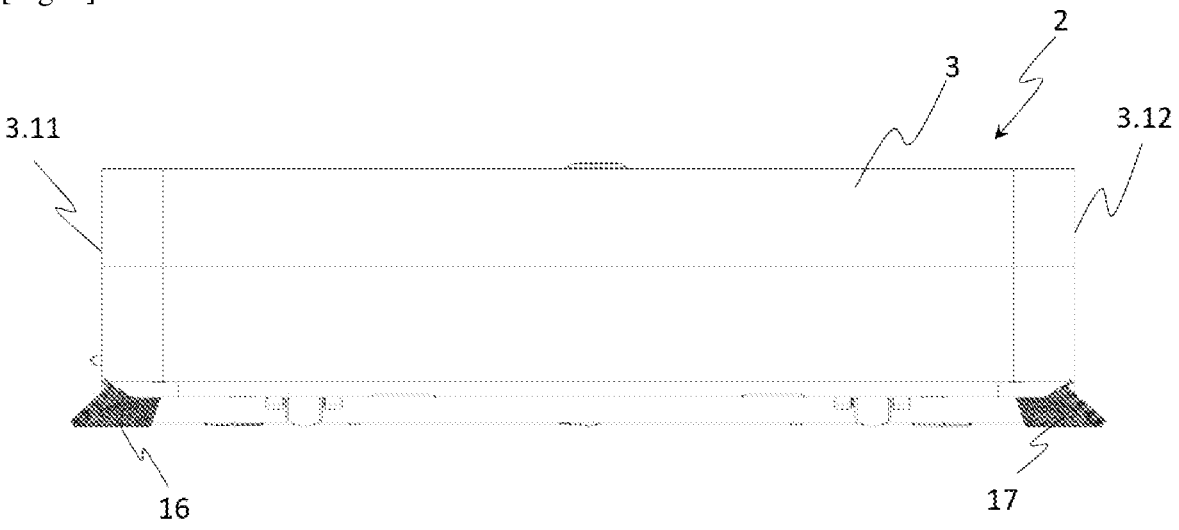

[Fig. 5]
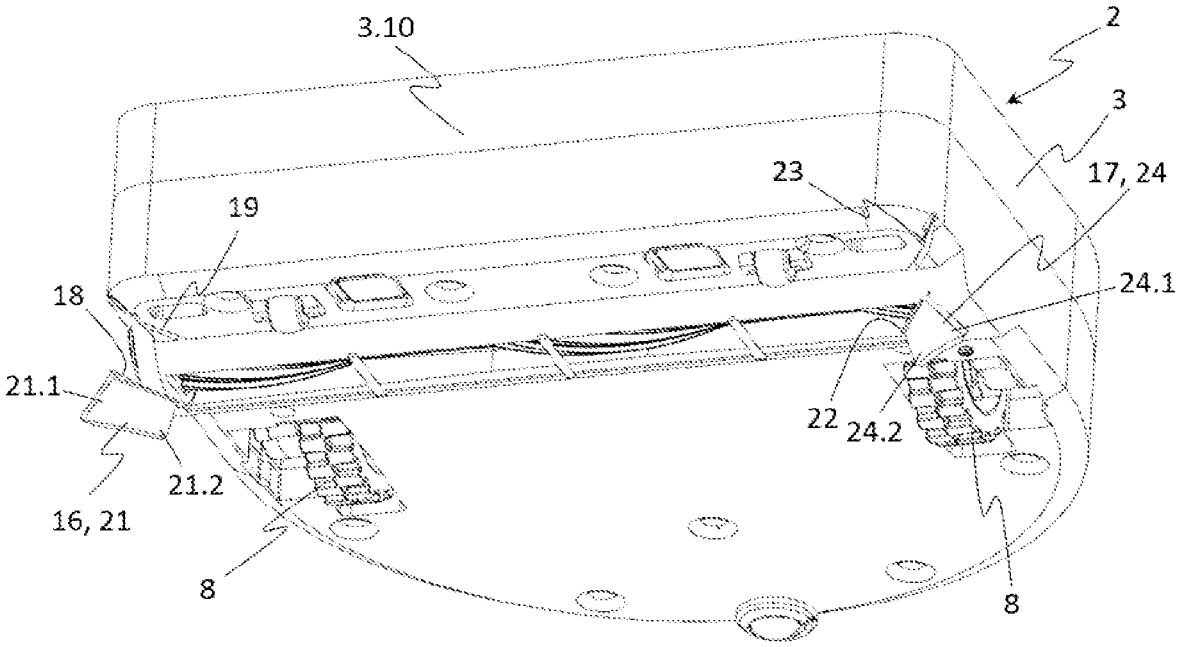
[Fig. 6]
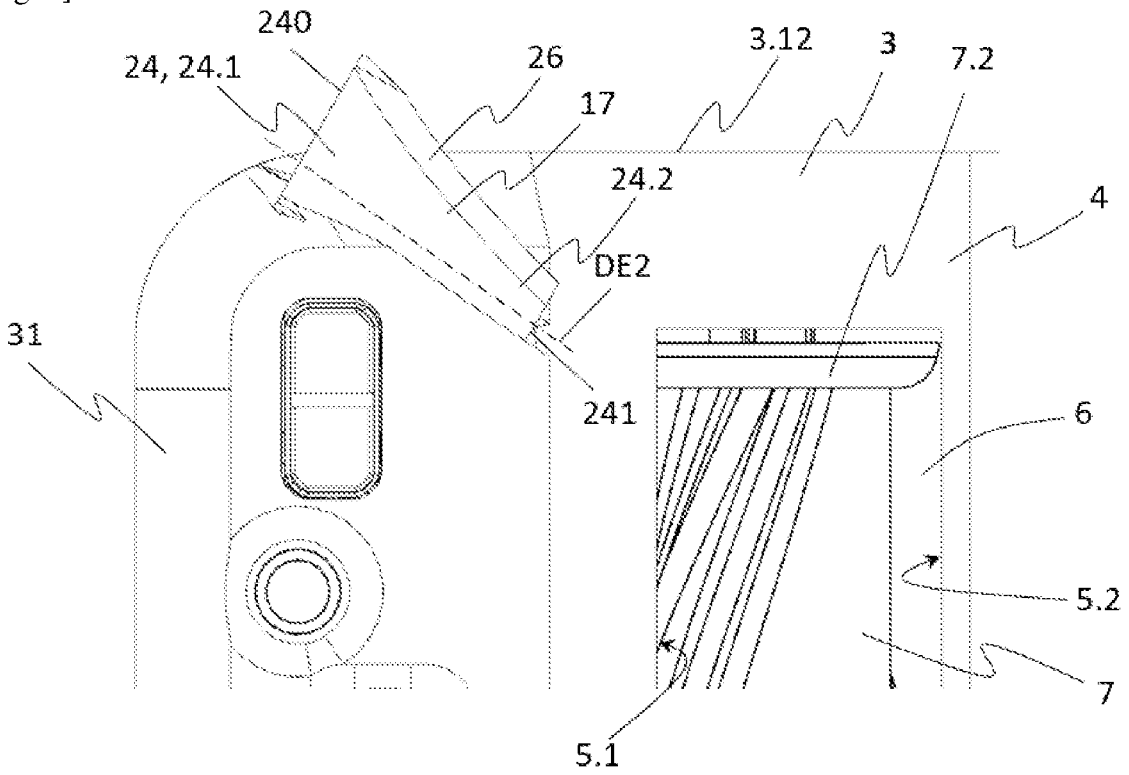

[Fig. 7]
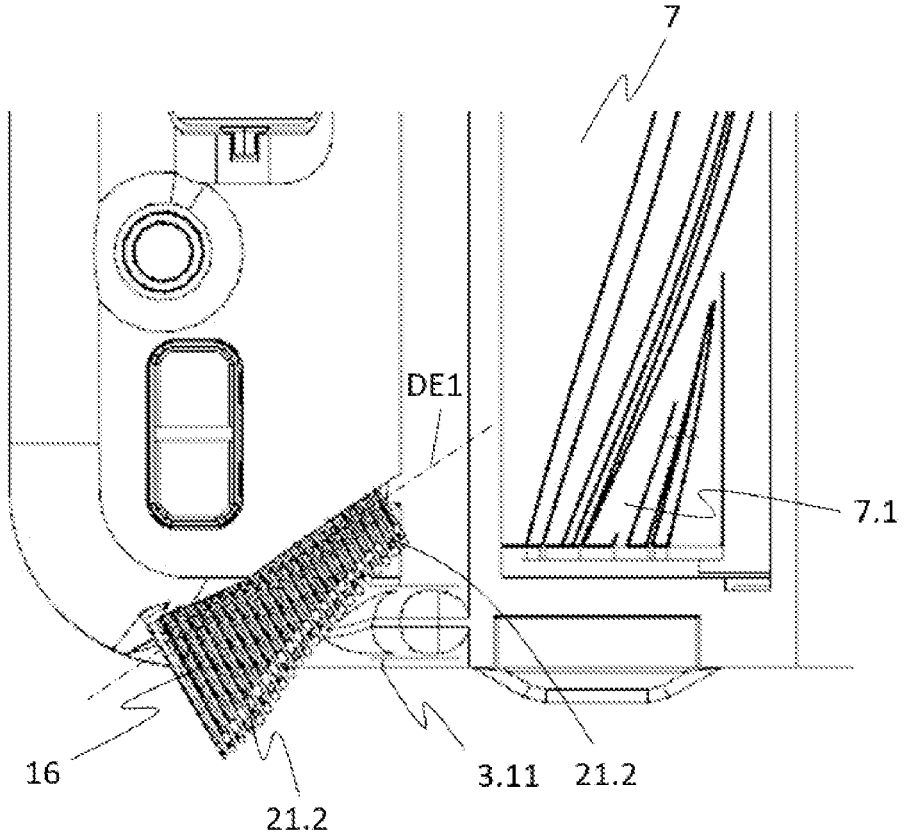
[Fig. 8]
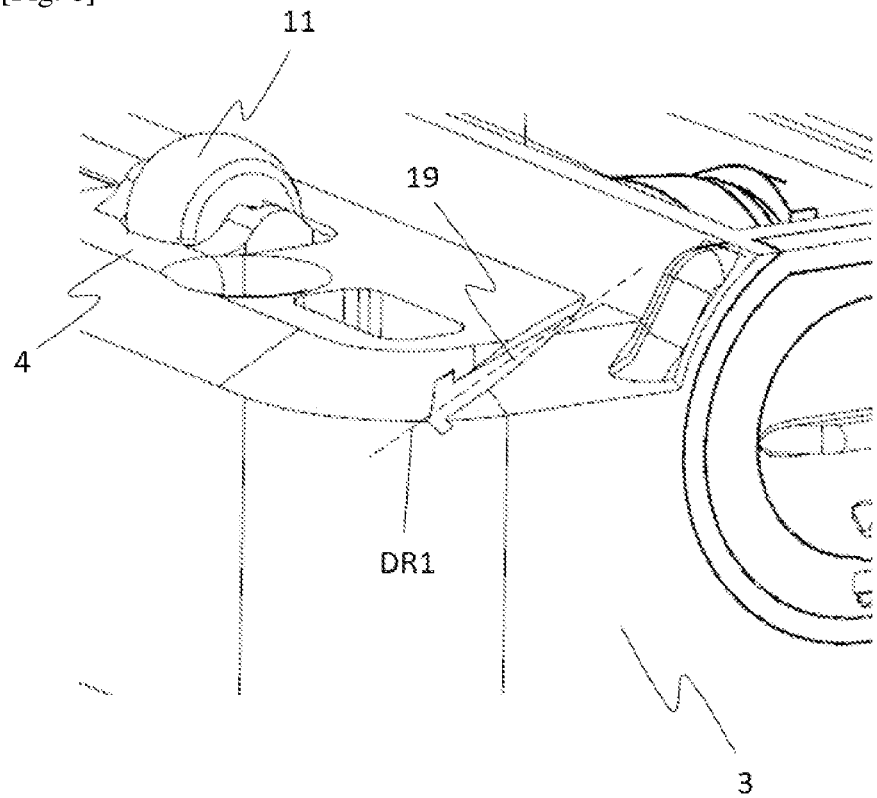

[Fig. 9]
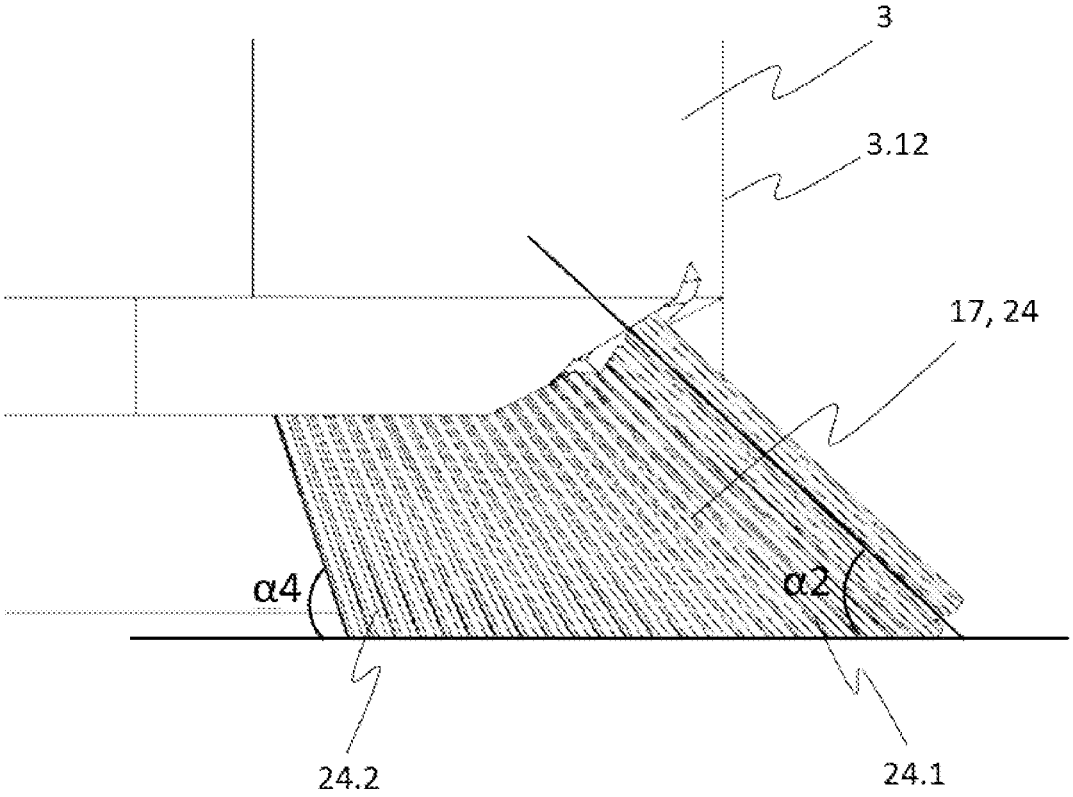
[Fig. 10]
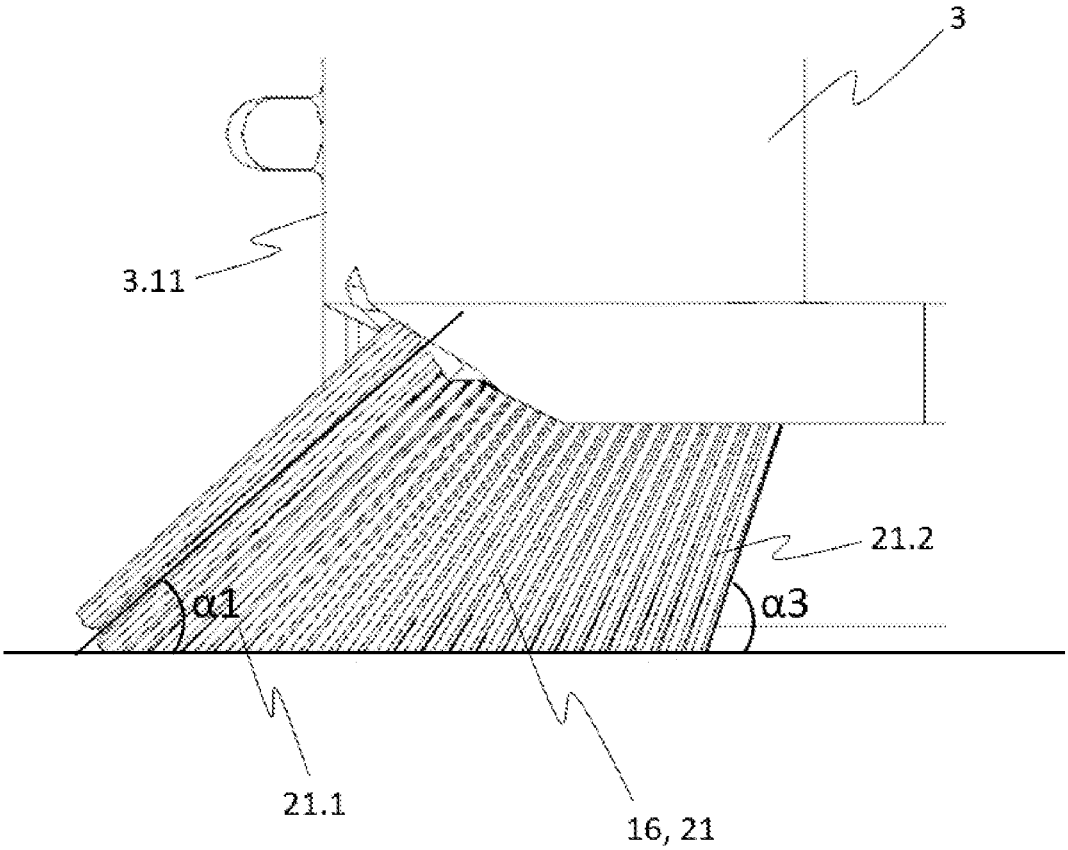

[Fig. 11]
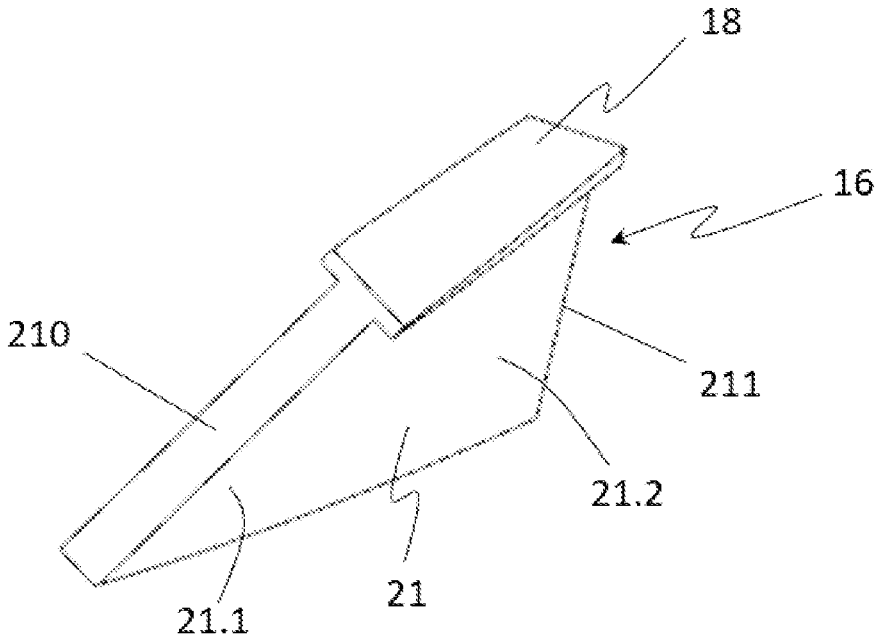
[Fig. 12]
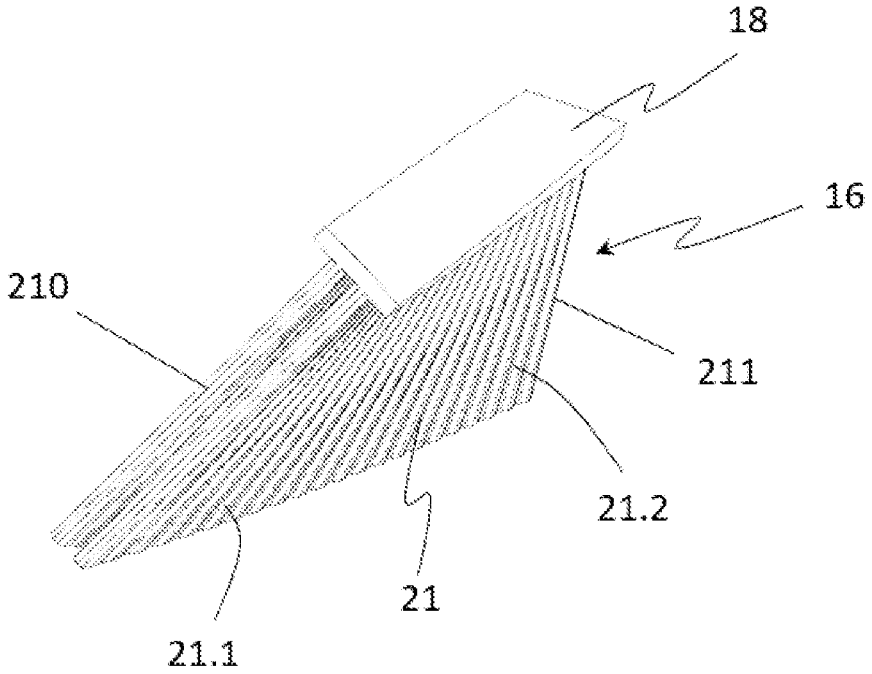

ROBOTIC VACUUM CLEANER WITH AT LEAST ONE FIXED SIDE CLEANING MEMBER

CROSS-REFERENCE TO RELATED APPLICATIONS

This application claims priority from French application number 2101608, filed Feb. 18, 2021, the disclosure of which is hereby incorporated herein by reference.

TECHNICAL FIELD

The present invention relates to the field of vacuum cleaner type cleaning devices and, more particularly, to the field of robotic vacuum cleaners that can move autonomously over a surface to be cleaned and can suck up dust and waste present on the surface to be cleaned, which can be, for example, tiles, parquet, laminate, carpet or a rug.

STATE OF THE ART

Robotic vacuum cleaners, more commonly known as robotic vacuum cleaners, have become commonplace nowadays, allowing for the cleaning of entire surfaces of a home without any assistance from the user as long as these surfaces are flat, i.e. on the same level. This saves users a lot of time for other activities.

A robotic vacuum cleaner includes in a known way:

a main body having an underside that is configured to face a surface to be cleaned, a suction port opening into the underside of the main body and extending transversely to a direction of travel of the robotic vacuum cleaner, and a receiving housing fluidly connected to the suction port, two driving wheels rotatably mounted on the main body and configured to roll on the surface to be cleaned, a main cleaning brush rotatably mounted in the receiving housing about an axis of rotation that extends transversely to the direction of travel of the robotic vacuum cleaner, a first side cleaning brush and a second side cleaning brush respectively located adjacent a first side edge and a second side edge of the main body, the first and second side cleaning brushes being rotatably mounted on a front part of the main body respectively about a first axis of rotation and a second axis of rotation which are vertical when the two driving wheels rest on the surface to be cleaned, and a drive mechanism configured to rotate the first and second side cleaning brushes.

The first and second side cleaning brushes are used to project waste, which is present for example in the vicinity of a wall along which the robot vacuum cleaner moves, away from the wall and, in particular, into the path of movement of the robotic vacuum cleaner so that the latter can suck up this waste.

However, some of the waste rejected by the first and second side cleaning brushes may be thrown up in areas already cleaned by the robotic vacuum cleaner. However, these areas will not be re-cleaned by the robotic vacuum cleaner if it is driven in a methodical, not random, manner. Thus, the quality of cleaning performed by such a robotic vacuum cleaner may not be satisfactory for a user.

In addition, due to the relatively fast rotation speed of the first and second side cleaning brushes and the fact that they are regularly rubbed against obstacles, the first and second side cleaning brushes wear out quickly and must therefore be replaced regularly.

Furthermore, since some of the mechanical components belonging to the aforementioned drive mechanism are arranged on either side of the two ends of the main cleaning brush, the lengths of the main cleaning brush and the suction port are necessarily limited (unless the robot vacuum cleaners footprint is increased, which is not desired), which limits the width of the surface that can be cleaned by the robotic vacuum cleaner during each of its movements and therefore increases the cleaning time of a given surface.

Such an arrangement of the mechanical components belonging to the drive mechanism also necessitates moving the main cleaning brush and the suction opening away from the side edges of the main body, which makes it difficult to clean surfaces in the immediate vicinity of obstacles or walls encountered by the robotic vacuum cleaner.

In addition, the first and second side cleaning brushes are ineffective on carpets. Indeed, only the main cleaning brush enables the fibers of a carpet or rug to be beaten and the dust retained by these fibers to be sucked up.

In addition, cables, cords or other elongated, flexible items are likely to become wrapped around the first and second side cleaning brushes, which can affect the operation and integrity of the robotic vacuum cleaner.

SUMMARY OF THE INVENTION

This invention is intended to remedy these disadvantages.

The technical problem at the basis of the invention consists in particular of providing a robotic vacuum cleaner which is simple and economical in structure, while at the same time allowing for efficient, quick and easy cleaning of a surface to be cleaned.

To this end, the subject matter of the invention is a robotic vacuum cleaner comprising:

a main body having an underside that is configured to face a surface to be cleaned, a suction port opening into the underside of the main body and extending transversely to a main direction of travel of the robotic vacuum cleaner, and a receiving housing fluidly connected to the suction opening, a rotating cleaning brush mounted in the receiving housing so as to be rotatable about an axis of rotation which extends transversely to the main direction of travel of the robotic vacuum cleaner, and a first side cleaning member mounted on a front part of the main body and located adjacent a first side edge of the main body, the first side cleaning member having a first cleaning part that is flexible.

The first side cleaning member is fixed with respect to the main body, and the first cleaning part is configured to direct waste, which comes into contact with the first cleaning part when the robotic vacuum cleaner moves along the main direction of travel, to the suction opening.

Such a configuration of the first side cleaning member, which is passive, makes it possible firstly to substantially simplify the robot vacuum cleaner, since no drive mechanism capable of driving the first side cleaning member is required, and secondly to significantly reduce the power consumption of the robotic vacuum cleaner and the frequency of replacement of the first side cleaning member. The costs of manufacturing and operating the robotic vacuum cleaner according to the present invention are therefore substantially limited.

Furthermore, since the first cleaning part is configured to direct to the suction opening waste that is encountered by the first cleaning part when the robotic vacuum cleaner moves along the main direction of travel, the robotic vacuum cleaner according to the present invention provides effective cleaning of a surface to be cleaned, including in the vicinity of obstacles encountered by the robotic vacuum cleaner.

In addition, the absence of a drive mechanism capable of driving the first side cleaning member, and thus of mechanical components adjacent the respective end of the rotating cleaning brush, makes it possible to increase the lengths of the rotating cleaning brush and of the suction opening, and thus to process a surface to be cleaned more quickly.

The robotic vacuum cleaner which is the subject of the present invention is designed, like the majority of robotic vacuum cleaners, to effectively clean floors when moving in a direction of travel parallel to the longitudinal axis of the robotic vacuum cleaner and in a predetermined direction of travel. The direction of travel parallel to the longitudinal axis of the robotic vacuum cleaner and the predetermined direction of travel define the aforementioned main direction of travel of the robotic vacuum cleaner which is the subject of the present invention. Thus, a front part or a rear part of the main body of the robotic vacuum cleaner is identified with respect to the main direction of travel of the robotic vacuum cleaner.

The robotic vacuum cleaner may further have one or more of the following features, taken alone or in combination.

According to one embodiment of the invention, the robotic vacuum cleaner further comprises a second side cleaning member mounted on the front part of the main body and located adjacent a second side edge of the main body, the second side cleaning member being fixed with respect to the main body and having a second cleaning part that is flexible, the first and second cleaning parts being configured to direct waste material, which comes into contact with the first and second cleaning parts when the robotic vacuum cleaner is moving according to the main direction of travel, towards the suction opening.

According to one embodiment of the invention, the distance between a front edge of the first cleaning part and the median longitudinal plane of the main body is greater than the distance between a rear edge of the first cleaning part and the median longitudinal plane of the main body. Advantageously, the distance between a front edge of the second cleaning part and the longitudinal midplane of the main body is greater than the distance between a rear edge of the second cleaning part and the longitudinal midplane of the main body.

According to one embodiment of the invention, the first and second cleaning parts converge toward each other toward a rear part of the main body. In other words, the front edges of the first and second cleaning parts are spaced apart by a first separation distance and the rear edges of the first and second cleaning parts are spaced apart by a second separation distance that is less than the first separation distance. Such a configuration of the first and second cleaning parts promotes the guidance of the waste encountered by the latter towards the suction opening, which further improves the cleaning efficiency of the robotic vacuum cleaner according to the present invention. Such a configuration of the first and second cleaning parts also makes it possible to direct the air flows under the robotic vacuum cleaner from the front of the robotic vacuum cleaner towards the suction opening, which promotes the suction of waste encountered by the robotic vacuum cleaner.

According to one embodiment of the invention, the first side cleaning member is elongated and extends generally along a first extension direction. Advantageously, the second side cleaning member is elongated and extends generally along a second extension direction. Advantageously, the first and second extension directions converge toward each other toward the rear part of the main body.

According to one embodiment of the invention, the first cleaning part is twisted along the first extension direction. Advantageously, the second cleaning part is twisted along the second extension direction. Such a configuration of the first and second cleaning parts makes it possible to vary the inclination of the first and second cleaning parts with respect to the horizontal, in particular to obtain a high opening angle of the first and second cleaning parts, and this, with first and second cleaning parts of reduced length. In particular, these arrangements bring the rotating cleaning brush closer to the front edge of the main body and also bring the ends of the rotating cleaning brush closer to the side edges of the main body, and thus further improve the cleaning efficiency of the robotic vacuum cleaner according to the present invention.

According to one embodiment of the invention, the first cleaning part has a generally flat shape. The first cleaning part can also have a wall or strip shape. Advantageously, the second cleaning part has a generally flat shape, or has a wall or strip shape.

According to one embodiment of the invention, the first and second cleaning parts are arranged symmetrically with respect to the median longitudinal plane of the main body. These provisions further improve the cleaning efficiency of the robotic vacuum cleaner according to the present invention.

According to one embodiment of the invention, at least a portion of the first cleaning part is inclined with respect to the horizontal and to the vertical when the robotic vacuum cleaner rests, in particular with its drive wheels, on a horizontal surface. Advantageously, at least a portion of the second cleaning part is inclined with respect to the horizontal and to the vertical when the robotic vacuum cleaner rests, in particular with its drive wheels, on a horizontal surface.

According to one embodiment of the invention, the first cleaning part has an inclination, with respect to the horizontal, that varies along the first cleaning part. Advantageously, the second cleaning part has an inclination, with respect to the horizontal, that varies along the second cleaning part.

According to one embodiment of the invention, the first cleaning part has an inclination, with respect to the horizontal, which increases towards the rear edge of the first cleaning part. Advantageously, the second cleaning part has an inclination, with respect to the horizontal, which increases towards the rear edge of the second cleaning part.

According to one embodiment of the invention, the first cleaning part comprises a first front wall portion that slopes downward and laterally outward from the main body. Advantageously, the second cleaning part comprises a second front wall portion that slopes downward and laterally outward from the main body.

According to one embodiment of the invention, the first front wall portion is formed by a plurality of bristles or tufts of bristles or is formed of a flexible material. Advantageously, the second front wall portion is formed by a plurality of bristles or tufts of bristles or is formed of a flexible material.

According to one embodiment of the invention, the first front wall portion is inclined with respect to the horizontal by an angle of inclination of between 30 and 60°, and advantageously between 35 and 45°. Advantageously, the second front wall portion is inclined with respect to the horizontal by an angle of inclination of between 30 and 60°, and advantageously between 35 and 45°.

According to one embodiment of the invention, the first cleaning part comprises a first rear wall portion which is inclined with respect to the horizontal by an angle of inclination of between 70 and 90°, advantageously between 80 and 90°. Advantageously, the second cleaning part comprises a second rear wall portion which is inclined with respect to the horizontal by an angle of inclination of between 70 and 90°, advantageously between 80 and 90°.

According to one embodiment of the invention, the first rear wall portion slopes downward and laterally outward from the main body. Advantageously, the second rear wall portion slopes downward and laterally outward from the main body.

According to one embodiment of the invention, the first rear wall portion is recessed from the first side edge of the main body. Advantageously, the second rear wall portion is set back from the second side edge of the main body.

According to one embodiment of the invention, at least a portion of the first cleaning part protrudes laterally from the first lateral edge of the main body. Advantageously, at least a portion of the second cleaning part projects laterally from the second side edge of the main body. These provisions allow the robotic vacuum cleaner to effectively clean surfaces along walls, for example, while allowing the robotic vacuum cleaner to travel along these walls without coming into contact with them.

According to one embodiment of the invention, the first front wall portion projects laterally from the first side edge of the main body. Advantageously, the second front wall portion projects laterally from the second side edge of the main body.

According to one embodiment of the invention, the first side cleaning member has a first attachment portion which is fixed in a first receiving groove provided on the main body, the first cleaning part being supported by the first attachment portion. Advantageously, the second side cleaning member comprises a second attachment portion which is fixed in a second receiving groove provided on the main body, the second cleaning part being supported by the second attachment portion.

According to one embodiment of the invention, the first receiving groove extends generally along a first groove direction. Advantageously, the first groove direction is inclined with respect to the median longitudinal plane of the main body by an angle of inclination of between 20 and 40°, for example between 25 and 35°, and advantageously by about 30°.

According to one embodiment of the invention, the second receiving groove extends generally along a second groove direction. Advantageously, the second groove direction is inclined with respect to the median longitudinal plane of the main body by an angle of inclination of between 20 and 40°, for example between 25 and 35°, and advantageously by about 30°.

According to one embodiment of the invention, the first and second groove directions converge toward each other toward the rear part of the main body.

According to one embodiment of the invention, the first and/or second groove direction(s) extend(s) substantially parallel to the median longitudinal plane of the main body.

According to one embodiment of the invention, the first and/or second receiving groove(s) is/are provided on the underside of the main body or on elements that make up the main body, and for example on a front bumper of the robotic vacuum cleaner.

According to one embodiment of the invention, the first receiving groove is twisted along the first groove direction. Advantageously, the second receiving groove is twisted along the second groove direction.

According to one embodiment of the invention, each of the first and second receiving grooves has a bottom wall that is flat or twisted.

According to one embodiment of the invention, the robotic vacuum cleaner includes at least a first deformation surface configured to deform the first side cleaning member, and for example the first cleaning part, such that at least a portion of the first cleaning part is inclined with respect to the horizontal and to the vertical when the robotic vacuum cleaner rests on a horizontal surface. Advantageously, the robotic vacuum cleaner includes at least one second deformation surface configured to deform the second side cleaning member, and for example the second cleaning part, such that at least a portion of the second cleaning part is inclined with respect to the horizontal and to the vertical when the robotic vacuum cleaner is resting on a horizontal surface.

According to one embodiment of the invention, the at least one first deformation surface is configured to deform the first side cleaning member, and for example the first cleaning part, such that the first cleaning part has an inclination, with respect to the horizontal, that varies along the first cleaning part. Advantageously, the at least one second deformation surface is configured to deform the second side cleaning member, and for example the second cleaning part, such that the second cleaning part has an inclination, with respect to the horizontal, that varies along the second cleaning part.

According to one embodiment of the invention, the main body includes a first deformation member, such as a deformation rib, comprising the at least one first deformation surface. The first deformation member can, for example, be provided on the underside of the main body.

According to one embodiment of the invention, the first receiving groove comprises the at least one first deformation surface. Advantageously, the second receiving groove comprises the at least one second deformation surface.

According to one embodiment of the invention, the at least one first deformation surface is formed by the bottom wall and/or at least one of the side walls of the first receiving groove. Advantageously, the at least one second deformation surface is formed by the bottom wall and/or at least one of the side walls of the second receiving groove.

According to one embodiment of the invention, the first side cleaning member is located in front of the axis of rotation of the rotating cleaning brush, and advantageously in front of the front edge of the suction opening.

According to one embodiment of the invention, the second side cleaning member is located in front of the axis of rotation of the rotating cleaning brush, and advantageously in front of the front edge of the suction opening.

According to one embodiment of the invention, the first side cleaning member is arranged set back from the front edge of the main body. Advantageously, the second side cleaning member is set back from the front edge of the main body.

According to one embodiment of the invention, the first side cleaning member protrudes from the underside of the main body by a first protrusion height that is substantially constant along the first side cleaning member. Advantageously, the second side cleaning member protrudes from the underside of the main body by a second protrusion height that is substantially constant along the second side cleaning member and is substantially identical to the first protrusion height. These arrangements ensure contact of each of the first and second side cleaning members with a floor to be cleaned along the entire length of the respective one of the first and second cleaning parts.

According to one embodiment of the invention, the first side cleaning member is formed by a first side cleaning brush. Advantageously, the second side cleaning member is formed by a second side cleaning brush.

According to one embodiment of the invention, the first cleaning part comprises at least a first row of bristles or tufts of bristles. Advantageously, the second cleaning part comprises at least a second row of bristles or tufts of bristles.

According to one embodiment of the invention, the first cleaning part is formed by a first cleaning lamella which is elastically deformable. Advantageously, the second cleaning part is formed by a second cleaning lamella which is elastically deformable.

According to one embodiment of the invention, the main body has a general D-shape when viewed from above.

According to one embodiment of the invention, the first cleaning part has a first lower elongated edge that extends along the entire length of the first cleaning part and is configured to contact a surface to be cleaned when the robotic vacuum cleaner rests on said surface to be cleaned. Advantageously, the second cleaning part comprises a second lower elongated edge that extends along the entire length of the second cleaning part and is configured to contact the surface to be cleaned when the robotic vacuum cleaner rests on said surface to be cleaned.

According to one embodiment of the invention, the rear end of the first lower elongated edge and a first end of the rotating cleaning brush are located at substantially the same distance from the first side edge of the main body. Advantageously, the rear end of the second lower elongated edge and a second end of the rotating cleaning brush are located at substantially the same distance from the second side edge of the main body.

According to one embodiment of the invention, the rear end of the first lower elongated edge is located adjacent a first end of the rotating cleaning brush.

Advantageously, the rear end of the second lower elongated edge is located adjacent a second end of the rotating cleaning brush.

According to one embodiment of the invention, the rear end of the first lower elongated edge is located adjacent a first side edge of the suction opening. Advantageously, the rear end of the second lower elongated edge is located adjacent a second side edge of the suction opening.

According to one embodiment of the invention, the axis of rotation of the rotating cleaning brush is substantially horizontal when the robotic vacuum cleaner rests on a horizontal surface.

BRIEF DESCRIPTION OF THE FIGURES

The purposes, aspects and advantages of this invention, according to the description given below of a particular embodiment of the invention presented by way of non-limiting example, will be better understood by referring to the attached drawings in which:

FIG. 1 is a top perspective view of a robotic vacuum cleaner according to the present invention.

FIG. 2 is a perspective view from below the robotic vacuum cleaner of FIG. 1.

FIG. 3 is a bottom view of the robotic vacuum cleaner of FIG. 1.

FIG. 4 is a front view of the robotic vacuum cleaner of FIG. 1.

FIG. 5 is an exploded perspective view from below the robotic vacuum cleaner of FIG. 1.

FIG. 6 is an enlarged scale view of a detail from FIG. 3.

FIG. 7 is a partial bottom view of the robotic vacuum cleaner of FIG. 1.

FIG. 8 is a partial perspective view from below the robotic vacuum cleaner of FIG. 1.

FIG. 9 is an enlarged scale view of a detail from FIG. 4.

FIG. 10 is an enlarged scale view of a detail from FIG. 4.

FIG. 11 is a perspective view of a first embodiment of a first cleaning member belonging to the robotic vacuum cleaner of FIG. 1.

FIG. 12 is a perspective view of a second embodiment of a first cleaning member belonging to the robotic vacuum cleaner of FIG. 1.

DETAILED DESCRIPTION

Only those elements necessary for understanding the invention are shown. In order to facilitate interpretation of the drawings, the same elements are labeled with the same references across all the figures.

Note that in this document, the terms "horizontal", "vertical", "lower", "upper", "height", "top", "above" used to describe the robot vacuum cleaner or the main body refer to the robotic vacuum cleaner in the situation of use when it rests with its wheels on a floor to be cleaned which is flat and horizontal.

FIGS. 1 to 12 show a robotic vacuum cleaner 2 configured to move autonomously over a surface to be cleaned.

The robotic vacuum cleaner 2 comprises a main body 3 having an underside 4 that is configured to face the surface to be cleaned, and a suction opening 5 that opens into the underside 4 of the main body 3. The suction opening 5 is elongated and extends transversely, and more particularly perpendicularly, to a main direction of travel D of the robotic vacuum cleaner 2. Advantageously, the suction opening 5 has a generally rectangular shape, and thus has a front edge 5.1 and a rear edge 5.2 that are substantially parallel.

The main body 3 further comprises a receiving housing 6 which is fluidly connected to the suction opening 5.

According to the embodiment shown in the figures, the front part 31 of the main body 3 has a generally rectangular shape when viewed from above, and the rear part 32 of the main body 3 has a generally semi-circular shape when viewed from above. Thus, the main body 3 has a general D-shape when viewed from above. However, the main body 3 could have any other shape when viewed from above, for example a circular or rectangular shape.

The robotic vacuum cleaner 2 further comprises a rotating cleaning brush 7 which is rotatably mounted in the receiving housing 6 about an axis of rotation A which extends transversely, and more particularly perpendicularly, to the main direction of travel D. Advantageously, the axis of rotation A of the rotating cleaning brush 7 is substantially horizontal when the robotic vacuum cleaner 2 rests on a horizontal surface.

The robotic vacuum cleaner 2 also includes a drive mechanism (not visible in the figures) that is configured to rotate the rotating cleaning brush 7 about the axis of rotation A.

As shown more particularly in FIG. 3, the robotic vacuum cleaner 2 comprises two drive wheels 8 which are mounted so as to be rotatable with respect to the main body 3, and which have substantially parallel, and advantageously merged, axes of rotation B.

The two drive wheels 8 are configured to project from the underside 4 of the main body 3, and are arranged on either side of the median longitudinal plane P of the main body 3. Advantageously, the two drive wheels 8 are arranged symmetrically with respect to the median longitudinal plane P of the main body 3.

The two drive wheels 8 are advantageously motorized independently of each other. Thus, the robotic vacuum cleaner 2 comprises two rotary drive mechanisms 9 housed in the main body 3 and each configured to rotate a respective drive wheel by the two drive wheels 8. Each rotary drive mechanism 9 comprises a drive motor rotatably coupled to the respective drive wheel and arranged, for example, in a respective side part of the main body 3 or in the rear part 32 of the main body 3. Depending on the control of the two aforementioned drive motors, the main body 3 can rotate to the left, to the right or on itself, and move forward or backward.

According to the embodiment shown in the figures, the robotic vacuum cleaner 2 has additional wheels 11 which are freely and rotatably mounted with respect to the main body 3 and which are arranged on the front part 31 of the main body 3, and for example between a front edge 3.10 of the main body 3 and the front edge 5.1 of the suction opening 5. Advantageously, the additional wheels are two in number and are arranged symmetrically with respect to the median longitudinal plane P of the main body 3.

The robotic vacuum cleaner 2 further comprises a suction unit (not visible in the figures) which is housed in the main body 3. The suction unit comprises an electric motor and a fan coupled to the electric motor to generate an air flow through the suction opening 5 and the receiving housing.

The robotic vacuum cleaner 2 also includes a waste collection device (not visible in the figures) which is arranged upstream of the suction unit and through which the air flow generated by the fan passes when the robotic vacuum cleaner 2 is in operation.

The robotic vacuum cleaner 2 also includes a power supply battery 15 configured to provide electrical power to the various electrical components housed in the main body 3. Advantageously, the power battery supply 15 is rechargeable and is housed in the main body 3.

The robotic vacuum cleaner 2 further comprises a control device 13 which is configured to control the operation of the robotic vacuum cleaner 2, and in particular to control the movements of the main body 3 for example according to random or methodical movements.

In particular, the control device 13 is configured to control the aforementioned rotary drive mechanisms based on data received from various sensors arranged on the main body 3, such as proximity sensors, contact sensors and/or drop sensors. The control device 13 may, for example, include an electronic card configured to receive and process these various data.

The robotic vacuum cleaner 2 further comprises a transmitter/receiver 14 that is configured to communicate with a docking station configured to accommodate the robotic vacuum cleaner 2, in particular during the recharging phases of the latter's power supply battery 15.

As shown in FIG. 2, the robotic vacuum cleaner 2 includes a first side cleaning member 16 and a second side cleaning member 17 that are fixed with respect to the main body 3. The first and second side cleaning members 16, 17 are located on the front part 31 of the main body 3 and are arranged respectively adjacent a first side edge 3.11 and a second side edge 3.12 of the main body 3. Advantageously, the first and second side cleaning members 16, 17 are located in front of the front edge 5.1 of the suction opening 5, and are set back from the front edge 3.10 of the main body 3.

According to the embodiment shown in the figures, the first and second lateral cleaning members 16, 17 are arranged symmetrically with respect to the median longitudinal plane P of the main body 3.

Advantageously, the first side cleaning member 16 protrudes from the underside 4 of the main body 3 by a first protrusion height that is substantially constant along the first side cleaning member 16, and the second side cleaning member 17 protrudes from the underside 4 of the main body 3 by a second protrusion height that is substantially constant along the second side cleaning member 17 and that is substantially identical to the first protrusion height.

According to the embodiment shown in the figures, the first and second side cleaning members are elongated and extend generally along a first extension direction DE1 and a second extension direction DE2 respectively.

The first side cleaning member 16 has a first attachment portion 18 which is elongated and is fixed in a first receiving groove 19 provided on the main body 3, and a first cleaning part 21 which is fixed to the first attachment portion 18 and projects from the first receiving groove 19. Similarly, the second side cleaning member 17 has a second attachment portion 22 that is elongated and is attached in a second receiving groove 23 provided on the main body 3, and a second cleaning part 24 that is attached to the second attachment portion 22 and protrudes from the second receiving groove 23. Advantageously, the first and second extension directions DE1, DE2 are respectively defined by the extension directions of the first and second fastening parts 18, 22.

Advantageously, each of the first and second cleaning parts 21, 24 is flexible and has a generally flat shape.

According to the embodiment shown in the figures, each of the first and second receiving grooves 19, 23 has a T-shaped cross-section, and each of the first and second attachment portions 18, 22 has a generally rectangular cross-section. However, the first and second receiving grooves 19, 23 and the first and second fastening parts 18, 22 could have cross sections of any other shape.

According to the embodiment shown in FIGS. 1 to 12, the first and second receiving grooves 19, 23 are provided on the underside 4 of the main body 3, and extend generally along first and second groove directions DR1, DR2, respectively, which converge toward each other in the direction of the rear part 32 of the main body 3. The first and second groove directions DR1, DR2 are respectively inclined with respect to the median longitudinal plane P of the main body 3 by an angle of inclination $\beta 1$ and an angle of inclination $\beta 2$ which are each between 20 and 40°, for example between 25 and 35°, and advantageously about 30°.

As shown more particularly in FIG. 3, the first and second cleaning parts 21, 24 are elongated and converge toward each other toward the rear part 32 of the main body 3. In other words, the front edges 210, 240 of the first and second cleaning parts 21, 24 are spaced apart by a first separation distance and the rear edges 211, 241 of the first and second cleaning parts 21, 24 are spaced apart by a second separation distance that is less than the first separation distance.

Thus, the first and second cleaning parts 21, 24 are configured to direct and guide waste, which comes into contact with either of the first and second cleaning parts 21, 24, to the suction opening 5 when the robotic vacuum cleaner 2 moves along the main direction of travel D.

According to the embodiment shown in FIGS. 1 to 12, the first and second extension directions DE1, DE2 are substantially horizontal when the robotic vacuum cleaner 2 rests, with its drive wheels 8, on a horizontal surface. However, each of the first and second extension directions DE1, DE2 could be inclined with respect to the horizontal by, for example, an angle of inclination between ±20°, and advantageously ±10°. Each of the first and second extension directions DE1, DE2 is advantageously inclined with respect to the median longitudinal plane P of the main body 3 by an angle of inclination of between 20° and 40°, for example between 25° and 35°, and advantageously of about 30°.

The first and second extension directions DE1, DE2 may be substantially parallel to the first and second groove directions DR1, DR2, respectively, or may be slightly inclined to the first and second groove directions DR1, DR2 respectively.

The first and second cleaning parts 21, 24 may respectively be formed by a first cleaning lamella and a second cleaning lamella that are elastically deformable (see in particular FIGS. 2, 3, 6 and 11). However, according to an alternative embodiment of the invention, the first and second cleaning parts 21, 24 may be formed respectively by one or more first row(s) of bristles or tufts of bristles extending along the first extension direction DE1 and one or more second row(s) of bristles or tufts of bristles extending along the second extension direction DE2 (see in particular FIGS. 4, 7, 9, 10 and 12). According to such an embodiment of the invention, the first and second side cleaning members 16, 17 then form first and second side cleaning brushes that are fixed relative to the main body 3.

According to the embodiment shown in the figures, the first and second cleaning parts 21, 24 are twisted along the first and second extension directions DE1, DE2, respectively, such that the first cleaning part 21 has an inclination, with respect to the horizontal, which varies along the first cleaning part 21, and such that the second cleaning part 24 has an inclination, with respect to the horizontal, which varies along the second cleaning part 24. Advantageously, the first and second cleaning parts 21, 24 are twisted such that the inclination of the first cleaning part 21, with respect to the horizontal, increases towards the rear edge 211 of the first cleaning part 21, and such that the inclination of the second cleaning part 24, with respect to the horizontal, increases towards the rear edge 241 of the second cleaning part 24.

As shown in FIGS. 9 and 10, the first cleaning part 21 includes a first front wall portion 21.1 that slopes downward and laterally outward from the main body 3, and the second cleaning part 24 includes a second front wall portion 24.1 that slopes downward and laterally outward from the main body 3. The first and second front parts 21.1, 24.1 are respectively inclined with respect to the horizontal by an angle of inclination $\alpha 1$ and an angle of inclination $\alpha 2$ which are each between 30 and 60°, and advantageously between 35 and 45°.

As shown in FIGS. 9 and 10, the first cleaning part 21 comprises a first rear wall portion 21.2 which is inclined with respect to the horizontal by an angle of inclination a3 between 70 and 90°, advantageously between 80 and 90°, and the second cleaning part 24 comprises a second rear wall portion 24.2 which is also inclined with respect to the horizontal by an angle of inclination a4 between 70 and 90°, advantageously between 80 and 90°. Advantageously, the first rear wall portion 21.2 slopes downward and laterally outward from the main body 3, and the second rear wall portion 24.2 slopes downward and laterally outward from the main body 3.

According to the embodiment shown in the figures, the first front wall portion 21.1 projects laterally from the first side edge 3.11 of the main body 3 and the first rear wall portion 21.2 is set back from the first side edge 3.11 of the main body 3. Similarly, the second front wall portion 24.1 projects laterally from the second side edge 3.12 of the main body 3, and the second rear wall portion 24.2 is set back from the second side edge 3.12 of the main body 3.

Advantageously, the first attachment portion 18 is set back from the first side edge 3.11 of the main body 3, and the second attachment portion 22 is also set back from the second side edge 3.12 of the main body 3. These arrangements prevent the first and second attachment portions 18, 22, which are generally more rigid than the first and second cleaning parts 21, 24, from coming into contact with obstacles encountered by the robotic vacuum cleaner, and degrading these obstacles or blocking the robotic vacuum cleaner.

As shown in FIG. 3, the first cleaning part 21 includes a first lower elongated edge 25 that extends along the entire length of the first cleaning part 21 and is configured to contact a surface to be cleaned when the robotic vacuum cleaner 2 is resting on the surface to be cleaned, and the second cleaning part 24 includes a second lower elongated edge 26 that extends along the entire length of the second cleaning part 24 and is configured to contact the surface to be cleaned when the robotic vacuum cleaner 2 is resting on said surface to be cleaned.

According to the embodiment shown in the figures, the rear end of the first lower elongated edge 25 and a first end 7.1 of the rotating cleaning brush 7 are located substantially at the same distance from the first side edge 3.11 of the main body 3, and the rear end of the second lower elongated edge 26 and a second end 7.2 of the rotating cleaning brush 7 are located substantially at the same distance from the second side edge 3.12 of the main body 3. Advantageously, the rear end of the first lower elongated edge 25 is located adjacent the first end 7.1 of the rotating cleaning brush 7, and the rear end of the second lower elongated edge 26 is located adjacent the second end 7.2 of the rotating cleaning brush 7.

As previously mentioned, the first and second cleaning parts 21, 24 are twisted along the first and second extension directions DE1, DE2 respectively. Such twisting of the first and second cleaning parts 21, 24 can be achieved in various ways.

For this purpose, the robotic vacuum cleaner 2 may, for example, comprise one or more first deformation surface(s) configured to deform the first side cleaning member 16 such that the first cleaning part 21 is twisted along the first extension direction DE1 and thus has an inclination, with respect to the horizontal, that varies along the first cleaning part 21, and one or more second deformation surface(s) configured to deform the second side cleaning member 17 such that the second cleaning part 24 is twisted along the second extension direction DE2 and thus has an inclination, with respect to the horizontal, that varies along the second cleaning part 24.

According to the embodiment shown in FIGS. 1 to 12, the bottom wall and the side walls of the first receiving groove 19 are twisted and thus form the aforementioned first deformation surfaces, and the bottom wall and the side walls of the second receiving groove 23 are twisted and thus form the aforementioned second deformation surfaces.

According to an alternative embodiment of the invention not shown in the figures, the bottom wall of each of the first and second receiving grooves 19, 23 could be flat, and only the side walls of the first receiving groove 19 could form the aforementioned first deformation surfaces and only the side walls of the second receiving groove 23 could form the aforementioned second deformation surfaces. According to yet another embodiment of the invention not shown in the figures, the robotic vacuum cleaner 2 could comprise a single first deformation surface that would be formed by one of the side walls of the first receiving groove 19 and a single second deformation surface that would be formed by one of the side walls of the second receiving groove 23.

According to another embodiment of the invention not shown in the figures, the main body 3 could comprise a first deformation member, such as a deformation rib, which is provided on the lower side 4 of the main body 3 and comprises a first deformation surface, and a second deformation member, such as a deformation rib, which is provided on the lower side 4 of the main body 3 and comprises a second deformation surface.

According to another embodiment of the invention, the robotic vacuum cleaner 2 could be devoid of first and second deformation surfaces, and the first and second cleaning parts 21, 24 could be shaped to be twisted.

According to one embodiment of the invention not shown in the figures, the rear end of the first lower elongated edge 25 could be located adjacent a first side edge of the suction opening 5, and the rear end of the second lower elongated edge 26 could be located adjacent a second side edge of the suction opening 5.

According to one embodiment not shown in the figures, the first and second cleaning parts 21, 24 could be flat (and not twisted) and each have an inclination, with respect to the horizontal, that would be constant along the respective one of the first and second extension directions DE1, DE2.

According to another embodiment not shown in the figures, the first and second receiving grooves 19, 23 could be substantially parallel to the median longitudinal plane P of the main body 3.

Of course, the invention is in no way limited to the described and illustrated embodiment, which was only provided by way of example. Changes can still be made, particularly with regard to the constitution of the various elements or by substituting technical equivalents, without departing from the scope of protection of the invention.

The invention claimed is:

1. A robotic vacuum cleaner comprising:

a main body having an underside configured to face a surface to be cleaned, a suction opening that opens into the underside of the main body and extending transversely to a main direction of travel of the robotic vacuum cleaner, and a receiving housing fluidly connected to the suction opening, a rotating cleaning brush rotatably mounted in the receiving housing about an axis of rotation extending transversely to the main direction of travel of the robotic vacuum cleaner, and a first side cleaning member mounted on a front part of the main body and located adjacent a first side edge of the main body, the first side cleaning member having a first cleaning part which is flexible, wherein the first side cleaning member is attached at a fixed location with respect to the main body, and wherein the first cleaning part is configured to direct waste, which comes into contact with the first cleaning part when the robotic vacuum cleaner moves in the main direction of travel, toward the suction opening, wherein the first cleaning part has an inclination, with respect to a horizontal direction, that varies along the first cleaning part.

2. The robotic vacuum cleaner according to claim 1, wherein a distance between a front edge of the first cleaning part and a median longitudinal plane of the main body is greater than a distance between a rear edge of the first cleaning part and the median longitudinal plane of the main body.

3. The robotic vacuum cleaner according to claim 1, wherein the first side cleaning member is elongated and extends generally along a first extension direction.

4. The robotic vacuum cleaner according to claim 3, wherein the first cleaning part is twisted along the first extension direction.

5. The robotic vacuum cleaner according to claim 1, wherein the first cleaning part has a substantially flat shape.

6. The robotic vacuum cleaner according to claim 1, wherein at least a portion of the first cleaning part is inclined to the horizontal direction and to a vertical direction when the robotic vacuum cleaner rests on a horizontal surface.

7. The robotic vacuum cleaner according to claim 1, wherein the first cleaning part comprises a first front wall portion which slopes downward and laterally outward from the main body.

8. The robotic vacuum cleaner according to claim 7, wherein the first front wall portion is inclined with respect to the horizontal direction by an angle of inclination between 30° and 60°.

9. The robotic vacuum cleaner according to claim 1, wherein the first cleaning part comprises a first rear wall portion that is inclined with respect to the horizontal direction by an angle of inclination between 70° and 90°.

10. The robotic vacuum cleaner according to claim 1, wherein at least a portion of the first cleaning part protrudes laterally from the first side edge of the main body.

11. The robotic vacuum cleaner according to claim 1, wherein the first side cleaning member has a first attachment portion which is attached at a fixed location in a first receiving groove provided on the main body, the first cleaning part being supported by the first attachment portion.

12. The robotic vacuum cleaner according to claim 1, wherein the first side cleaning member is located in front of the axis of rotation of the rotating cleaning brush.

13. The robotic vacuum cleaner according to claim 1, wherein the first side cleaning member is formed by a first side cleaning brush.

14. The robotic vacuum cleaner according to claim 1, wherein the first cleaning part is formed by a first cleaning lamella that is elastically deformable.

15. The robotic vacuum cleaner according to claim 1, further comprising a second side cleaning member mounted on the front part of the main body and located adjacent a second side edge of the main body, the second side cleaning member is attached at a fixed location with respect to the main body and having a second cleaning part which is flexible, the first and second cleaning parts being configured to direct waste, which comes into contact with the first and second cleaning parts when the robotic vacuum cleaner is moving along the main direction of travel, toward the suction opening.

16. The robotic vacuum cleaner according to claim 15, wherein the first and second cleaning parts converge toward each other toward a rear part of the main body.

* * * * *